US007921751B2

(12) United States Patent
Hu

(10) Patent No.: US 7,921,751 B2
(45) **Date of Patent: *Apr. 12, 2011**

(54) EASY-TO-MANUFACTURE RATCHET WRENCH

(76) Inventor: Bobby Hu, Taichung (TW)

( * ) Notice: Subject to any disclaimer, the term of this patent is extended or adjusted under 35 U.S.C. 154(b) by 92 days.

This patent is subject to a terminal disclaimer.

(21) Appl. No.: 12/412,439

(22) Filed: Mar. 27, 2009

(65) Prior Publication Data

US 2010/0031783 A1 Feb. 11, 2010

(30) Foreign Application Priority Data

Aug. 8, 2008 (TW) ..... 97130419 A

(51) Int. Cl.
*B25B 13/46* (2006.01)

(52) U.S. Cl. ..... 81/63.1

(58) Field of Classification Search ..... 81/60–63.2
See application file for complete search history.

(56) References Cited

U.S. PATENT DOCUMENTS

| | | | | |
|---|---|---|---|---|
| 6,981,434 | B2 | 1/2006 | Chen | 81/63.1 |
| 7,124,664 | B1 * | 10/2006 | Lee | 81/63.1 |
| 7,146,883 | B2 | 12/2006 | Chen | 81/63.2 |
| 2009/0314139 | A1 * | 12/2009 | Hu | 81/63.1 |
| 2010/0000376 | A1 * | 1/2010 | Hu | 81/63.1 |
| 2010/0018357 | A1 * | 1/2010 | Hu | 81/63.1 |
| 2010/0037735 | A1 * | 2/2010 | Hu | 81/62 |

* cited by examiner

*Primary Examiner* — Hadi Shakeri
(74) *Attorney, Agent, or Firm* — Alan Kamrath; Kamrath & Associates PA

(57) ABSTRACT

A ratchet wrench includes a body having a first compartment rotatably receiving a drive member and a second compartment slideably receiving two pawls. A positioning member extends into the second compartment. A switch is slideably mounted to the body and includes two legs extending into the second compartment for moving the pawls. A restraining member is slideably received in the compartment and coupled to the legs to move therewith. The restraining member includes at least two positioning sections selectively engaged with the positioning member corresponding to at least two positions of the switch.

20 Claims, 11 Drawing Sheets

EASY-TO-MANUFACTURE RATCHET WRENCH

BACKGROUND OF THE INVENTION

The present invention relates to a ratchet wrench and, more particularly, to a ratchet wrench that is easy to manufacture while providing reliable switching of the driving direction of the ratchet wrench.

A ratchet wrench generally includes a body having a head. In a type of reversible ratchet wrenches, the head includes a mounting recess rotatably receiving a ratchet wheel. The head further includes a receiving recess slideably receiving a pawl member. A direction control knob includes a shaft coupled with a driving member that is pivotally connected to the pawl member. Thus, pivotal movement of the direction control knob causes sliding of the pawl member and changes the coupling relationship between the pawl member and the ratchet wheel, thereby changing the driving direction of the ratchet wrench. The head further includes a positioning hole receiving a ball biased by a spring to position the direction control knob. An example of such a reversible ratchet wrench is disclosed in U.S. Pat. No. 7,146,883. However, the costs for manufacturing the body with the mounting recess, the receiving recess, and the positioning hole are high. Formation of the positioning hole coaxial with the longitudinal axis of the body is particularly difficult. Furthermore, the direction switching of the ratchet wrench including only one pawl member is not reliable.

In another type of reversible ratchet wrench, the head includes a through-hole rotatably receiving a drive member. A recess is defined in an inner periphery of the through-hole and receives two pawls each having a protrusion. A spring is mounted between the pawls to bias the pawl to engage with the drive member. The protrusions of the pawls extend into a recessed area defined in a side of the head. A control member is rotatably received in a central hole in the recessed area. The control member includes two dents in an underside thereof. The recessed area further includes a positioning hole receiving a spring and a ball biased by the spring into one of the dents corresponding to two opposite driving directions of the ratchet wrench. An example of reversible ratchet wrenches of this type is disclosed in U.S. Pat. No. 6,981,434. Such a ratchet wrench is easier to manufacture and has more reliable direction switching effect than the above-mentioned type. However, the direction switching effect is still unsatisfactory, for the protrusion of each pawl is liable to disengage from the switch.

Furthermore, fatigue of the springs or undesired distortion during movement of the switch causes a malfunction in the driving direction switching of the ratchet wrenches of both types. Further, unreliable positioning occurs when the ball wears out due to repeated rolling in the positioning hole. Unreliable positioning also occurs when movement of the ball is obstructed due to existence of impurities in the positioning hole or due to rusting of the ball and/or the spring resulting from entrance of moisture into the positioning hole.

Thus, a need exists for a ratchet wrench that is easy to manufacture while providing reliable driving direction-switching operation.

BRIEF SUMMARY OF THE INVENTION

The present invention solves this need and other problems in the field of easy manufacturing of ratchet wrenches by providing, in a preferred form, a ratchet wrench including a body having a first compartment and a second compartment in communication with the first compartment. A positioning member extends into the second compartment. A drive member is rotatably received in the first compartment of the body about a rotating axis and includes a plurality of teeth on an outer periphery thereof. First and second pawls are movably received in the second compartment. Each pawl includes an inner face having a plurality of teeth releasably engaged with the teeth of the drive member. Each pawl includes a top face transverse to the inner face. The top face of each pawl has a coupling portion. An elastic element is mounted between the first and second pawls to bias the teeth of the first and second pawls to engage with the teeth of the drive member. A switch is slideably mounted to the body. In preferred forms, the switch is pivotably mounted to the body about a pivot axis between first and second positions. The switch includes a manually operable operative portion and first and second legs extending from the operative portion into the second compartment. A restraining member is slideably received in the second compartment and coupled with the first and second legs of the switch to move therewith. The restraining member includes first and second positioning sections selectively engaged with the positioning member corresponding to the first and second positions of the switch.

When the switch is in the first position, the first leg of the switch engages with the coupling portion of the first pawl to disengage the teeth of the first pawl from the teeth of the drive member, and the teeth of the second pawl engage with the teeth of the drive member, allowing the body and the drive member to rotate in a first direction driving a fastener in the first direction and allowing the body to rotate freely relative to the drive member in a second direction reverse to the first direction without driving the fastener. The positioning member is engaged with the first positioning section to retain the switch in the first position.

When the switch is in the second position, the second leg of the switch engages with the coupling portion of the second pawl to disengage the teeth of the second pawl from the teeth of the drive member, and the teeth of the first pawl engage with the teeth of the drive member, allowing the body and the drive member to rotate in the second direction driving the fastener in the second direction and allowing the body to rotate freely relative to the drive member in the first direction without driving the fastener. The positioning member is engaged with the second positioning section to retain the switch in the second position.

In a preferred form, a receiving hole extends from a side of the body to the second compartment in the thickness direction, and the positioning member is in the form of a ball not movably but rotatably received in the receiving hole and partially extending into the second compartment. In another preferred form, the positioning member is in the form of a protrusion. The protrusion and the body are integrally formed as a single and inseparable component of the same material.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
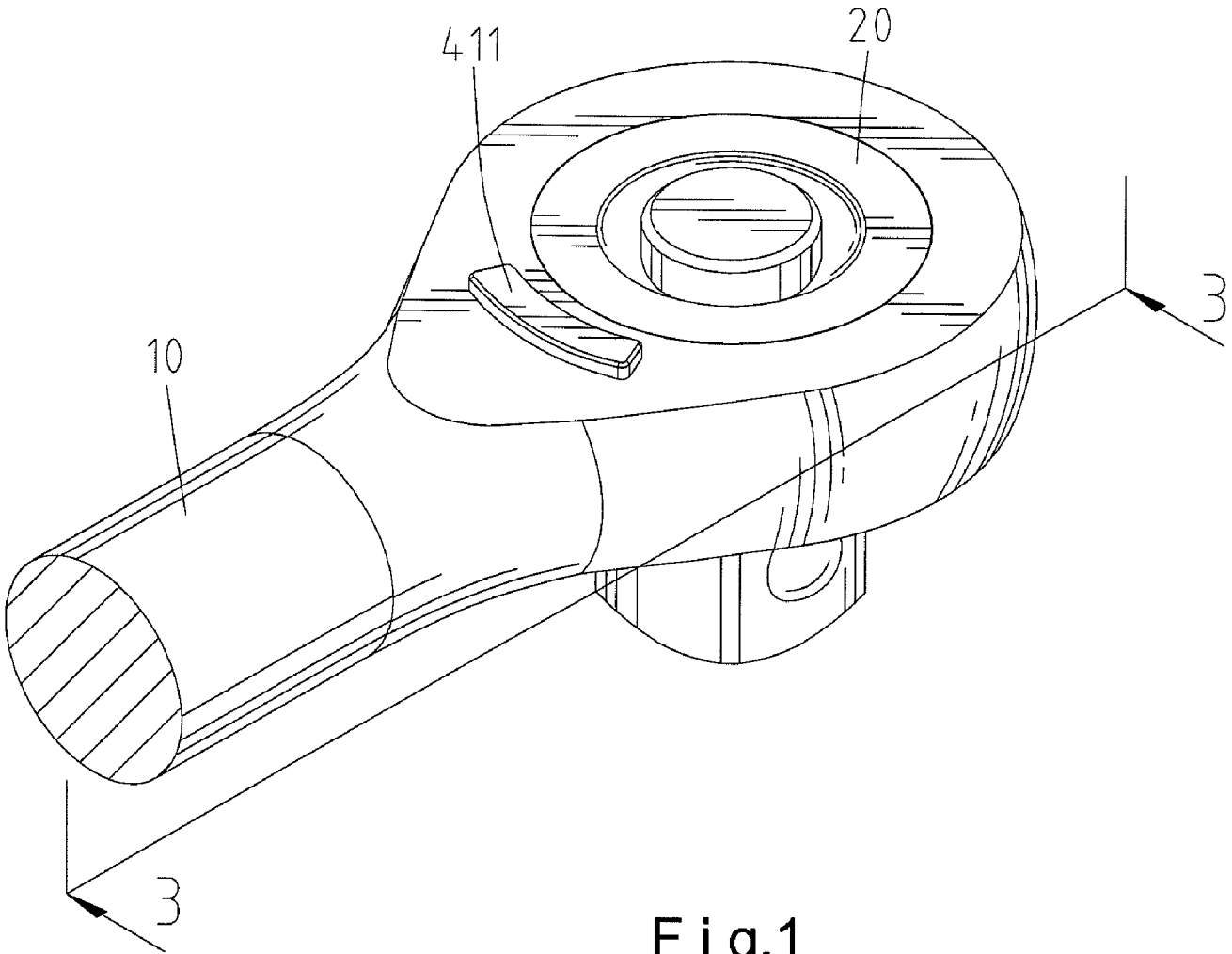
FIG. 1 shows a partial, perspective view of a ratchet wrench of an embodiment according to the preferred teachings of the present invention.
Figure 2:
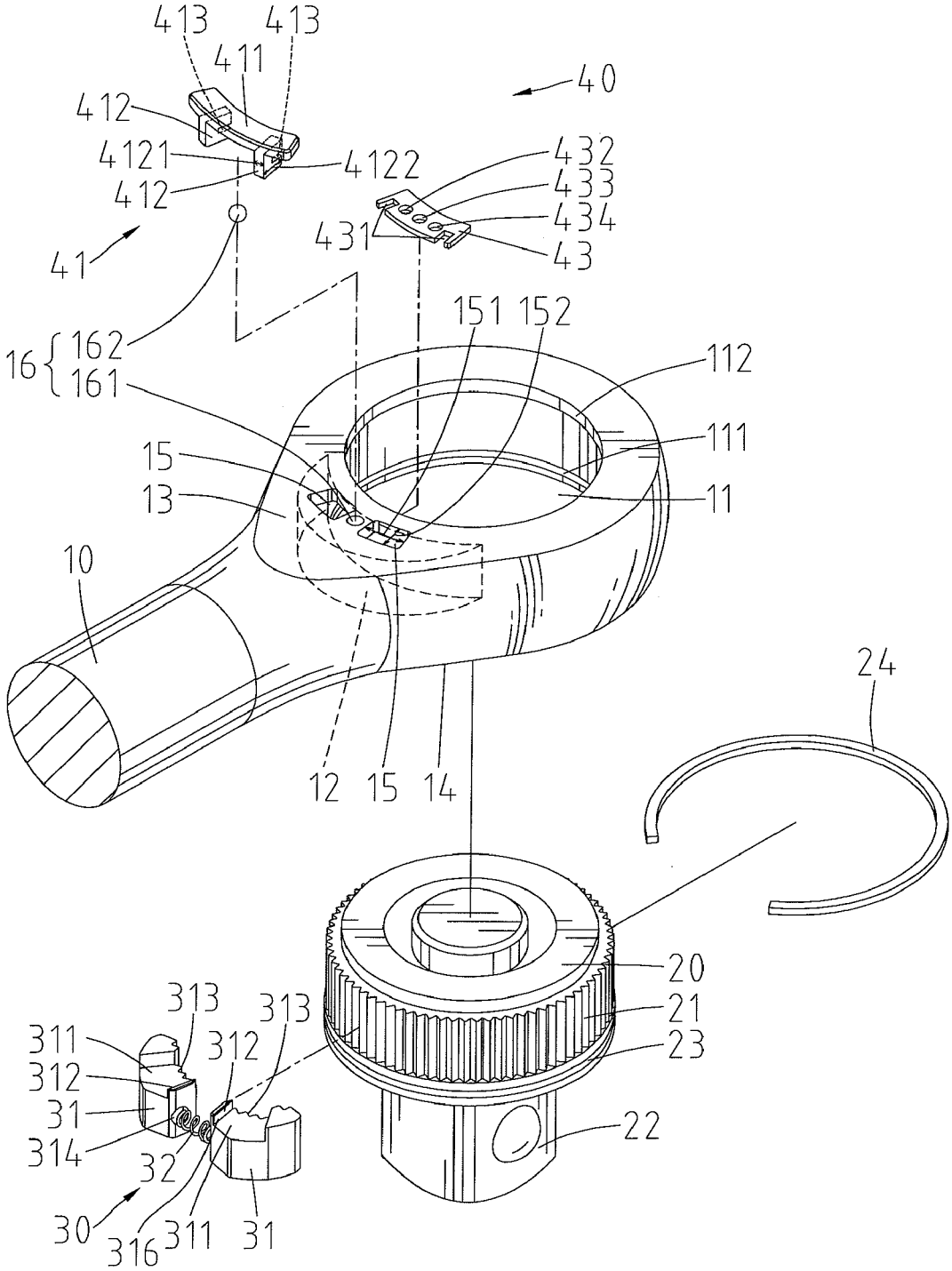
FIG. 2 shows a partial, exploded, perspective view of the ratchet wrench of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "circumferential", "radial", "clockwise", "counterclockwise", "length", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A ratchet wrench according to the preferred teachings of the present invention is shown in the drawings. In the preferred forms shown in FIGS. 1-11, the ratchet wrench includes a body 10 having first and second sides 13 and 14 spaced in a thickness direction. Body 10 includes a first compartment 11 that is circular in cross section. Body 10 further includes a second compartment 12 formed in a peripheral wall of first compartment 11 and intermediate first and second sides 13 and 14. Second compartment 12 is crescent in cross section. First side 13 includes an opening 112 in communication with first compartment 11. Further, an annular groove 111 is defined in an end of the peripheral wall of first compartment 11. Body 10 further includes first and second guide slots 15 extending from first side 13 to second compartment 12 in the thickness direction. First and second guide slots 15 extend and are spaced in a circumferential direction surrounding the rotating axis. Each of first and second guide slots 15 includes a circumferential length 151 in the circumferential direction and a radial length 152 in a radial direction orthogonal to the circumferential direction. Body 10 further includes an inner surface 131 which delimits second compartment 12.

The ratchet wrench according to the preferred teachings of the present invention further includes a positioning device 16. In the preferred form shown in FIGS. 1-9, positioning device 16 includes a receiving hole 161 extending from first side 13 of body 10 to second compartment 12 in the thickness direction, with first and second guide slots 15 located on opposite sides of receiving hole 161. Furthermore, positioning device 16 includes a positioning member 162 in the form of a ball not movably but rotatably received in receiving hole 161. Furthermore, the ball partially protrudes into second compartment 12. In the preferred form shown in FIGS. 10-11, positioning device 16 includes a positioning member 162 in the form of a protrusion extending from inner surface 131 of body 10 into second compartment 12. The protrusion and body 10 are integrally formed as a single and inseparable component of the same material. First side 13 of body 10 can be punched to form a depression 171 in first side 13 and to form the protrusion on inner surface 131.

In the preferred forms shown in FIGS. 1-11, a drive member 20 is rotatably received in first compartment 11 about a rotating axis extending in the thickness direction. Drive member 20 includes a plurality of teeth 21 on an outer periphery thereof. The outer periphery of drive member 20 further includes an annular groove 23. A C-clip 24 is received in annular groove 23 of drive member 20 and annular groove 111 of body 10 to allow rotational movement of body 10 relative to drive member 20 while retaining drive member 20 in first compartment 11. Drive member 20 further includes a driving section 22 for directly or indirectly engaging with a fastener to be loosened or tightened. In the preferred form shown in FIGS. 1-8 and 10-11, driving section 22 is in the form of a drive column for coupling with a socket. In the preferred form shown in FIG. 9, driving section 22 includes a through-hole having a polygonal inner periphery for engaging and driving a fastener. Other forms of driving section 22 would be within the skill of the art.

In the preferred forms shown in FIGS. 1-11, a pawl device 30 including first and second pawls 31 is slideably received in second compartment 12 of body 10. Each of first and second pawls 31 includes an inner face facing teeth 21 of drive member 20. The inner face of each of first and second pawls 31 includes a plurality of teeth 313 releasably engaged with teeth 21 of drive member 20. Each of first and second pawls 31 further includes a top face transverse to the inner face and facing inner surface 131. The top face of each of first and second pawls 31 includes a receiving portion 311 and a coupling portion 312. Specifically, coupling portion 312 extends upward from the top face of each of first and second pawls 31 in the thickness direction and includes a planar inner surface 316 facing away from the other pawl 31 and extending in a plane including the rotating axis of drive member 20. Each of first and second pawls 31 further includes an end face transverse to the top face and to the inner face. The end faces of the first and second pawls 31 face each other, and each has a receptacle 314. An elastic element 32 in the form of a spring is attached between first and second pawls 31 and includes two ends received in receptacles 314. Elastic element 32 biases first and second pawls 31 away from each other to engage teeth 313 of first and second pawls 31 with teeth 21 of drive member 20.

In the preferred forms shown in FIGS. 1-11, a switch device 40 includes a switch 41 pivotably mounted to body 10 about a pivot axis coincident with the rotating axis of drive member 20. Switch 41 is arcuate and includes a manually operable operative portion 411 and first and second legs 412 extending perpendicularly from operative portion 411 in the thickness direction. Operative portion 411 is mounted to first side 13 of body 10. First leg 412 extends through first guide slot 15 into second compartment 12 and is slideably received in receiving portion 311 of first pawl 31. Second leg 412 extends through second guide slot 15 into second compartment 12 and is slideably received in receiving portion 311 of second pawl 31. First and second legs 412 of switch 12 are spaced in the circumferential direction in which switch 12 pivots about the pivot axis. First leg 412 extends in a first plane including the rotating axis of drive member 20. Second leg 412 extends in a second plane including the rotating axis of drive member 20. The first plane is at an acute angle with the second plane. Each of first and second legs 412 includes a notch 413 formed in an intermediate portion thereof. Notch 413 faces drive member 20 and extends in the circumferential direction. Furthermore, each of first and second legs 412 includes a length 4122 in the radial direction and a thickness 4121 in the circumferential direction. Length 4122 of each of first and second legs 412 is equal to radial length 152 of each of first and second guide slots 15. Thickness 4121 of each of first and second legs 412 is smaller than circumferential length 151 of each of first and second guide slots 15. Thus, first and second legs 412 are slideably received in first and second guide slots 15 in the circumferential direction without the risk of disengaging from first and second guide slots 15. In the preferred form shown in FIGS. 1-9, operative portion 411 covers first and second guide slots 15 and receiving hole 161. In the preferred form shown in FIGS. 10-11, operative portion 411 covers first and second guide slots 15 and depression 171. It can be appreciated that switch 41 can be simply slideable relative to body 10 without pivoting about the rotating axis of drive member 20.

In the preferred forms shown in FIGS. 1-11, switch device 40 further includes a restraining member 43 slideably received in second compartment 12 and coupled with first and second legs 412 of switch 41 to move therewith. Restraining member 43 includes first and second ends spaced in the circumferential direction. The first end of restraining member 43 includes a first cutout 431. The second end of restraining member 43 includes a second cutout 431 spaced from first cutout 431 in the circumferential direction. Restraining member 43 further includes first and second shorter sides spaced in the circumferential direction. Restraining member 43 further includes first and second longer sides extending between the first and second shorter sides and spaced in a radial direction orthogonal to the circumferential direction. Each of the first and second longer sides has a length in the circumferential direction larger than a length of the first and second shorter sides in the radial direction. The second longer side is radially outwards of the first longer side and faces away from drive member 20. First and second cutouts 431 are formed in the first and second ends of restraining member 43 at the second longer side and face away from drive member 20. First cutout 431 is engaged with notch 413 of first leg 412, and second cutout 431 is engaged with notch 413 of second leg 412.

In the preferred form shown in FIGS. 1-8 and 10-11, restraining member 43 includes first, second, and third positioning sections 432, 434, and 433 to retain switch 41 in one of first, second, and third positions. First, second, and third positioning sections 432, 434, and 433 are spaced in the circumferential direction and intermediate first and second cutouts 431. Furthermore, third positioning section 433 is intermediate first and second positioning sections 432 and 434 in the circumferential direction. Each of first, second, and third positioning sections 432, 434 and 433 includes a cylindrical hole extending in the thickness direction, with the cylindrical hole being circular in cross section and having a diameter the same as that of the ball. In the preferred form shown in FIG. 9, restraining member 43 only includes first and second positioning sections 432 and 434 to retain switch 41 in one of the first and second positions.

Figure 3:
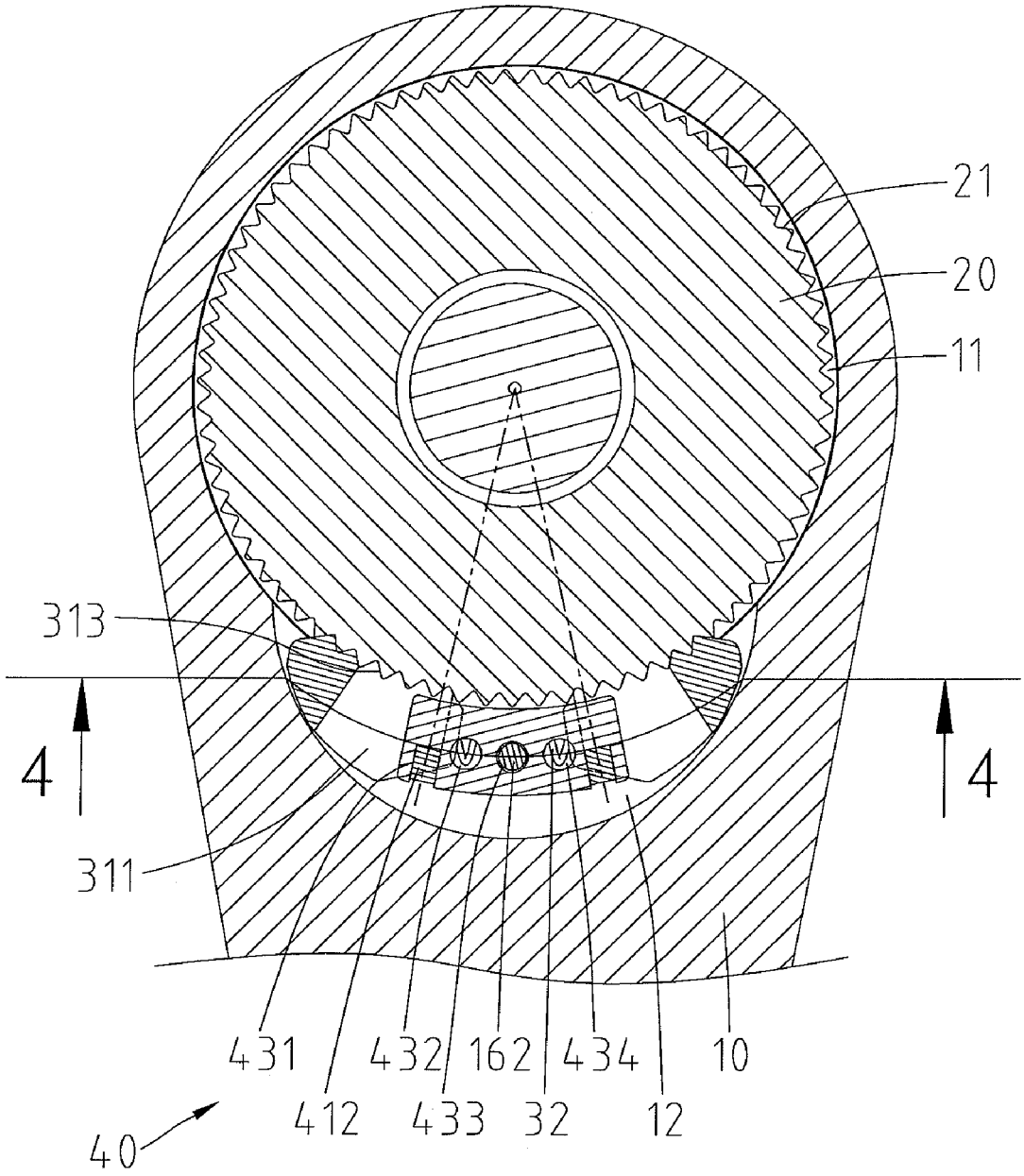
FIG. 3 shows a partial, cross sectional view of the ratchet wrench of FIG. 1 according to section line 3-3 of FIG. 1 with a switch in a third position.
Figure 4:
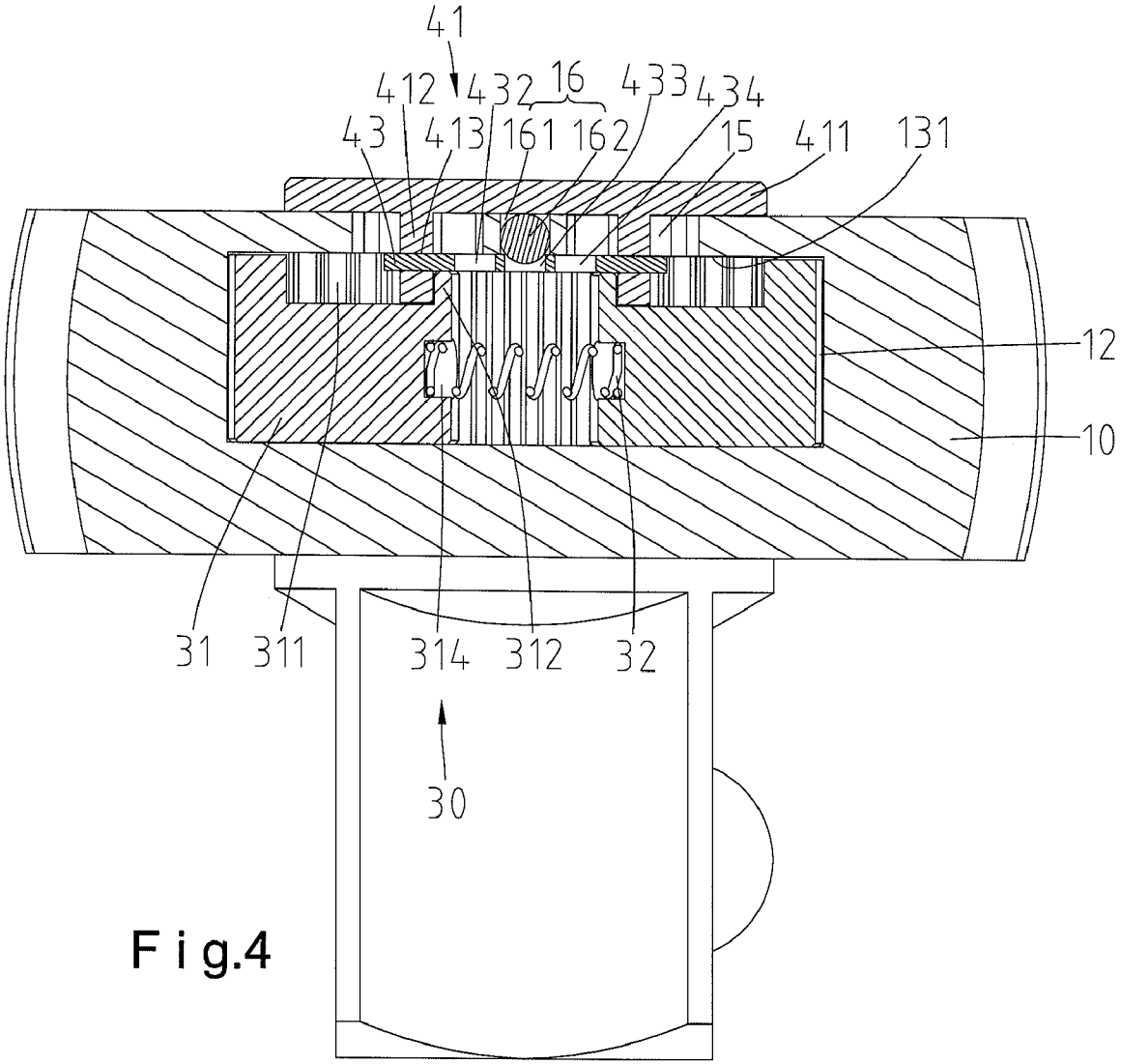
FIG. 4 shows another partial, cross sectional view of the ratchet wrench of FIG. 1 according to section line 4-4 of FIG. 3 with the switch in the third position.
Figure 5:
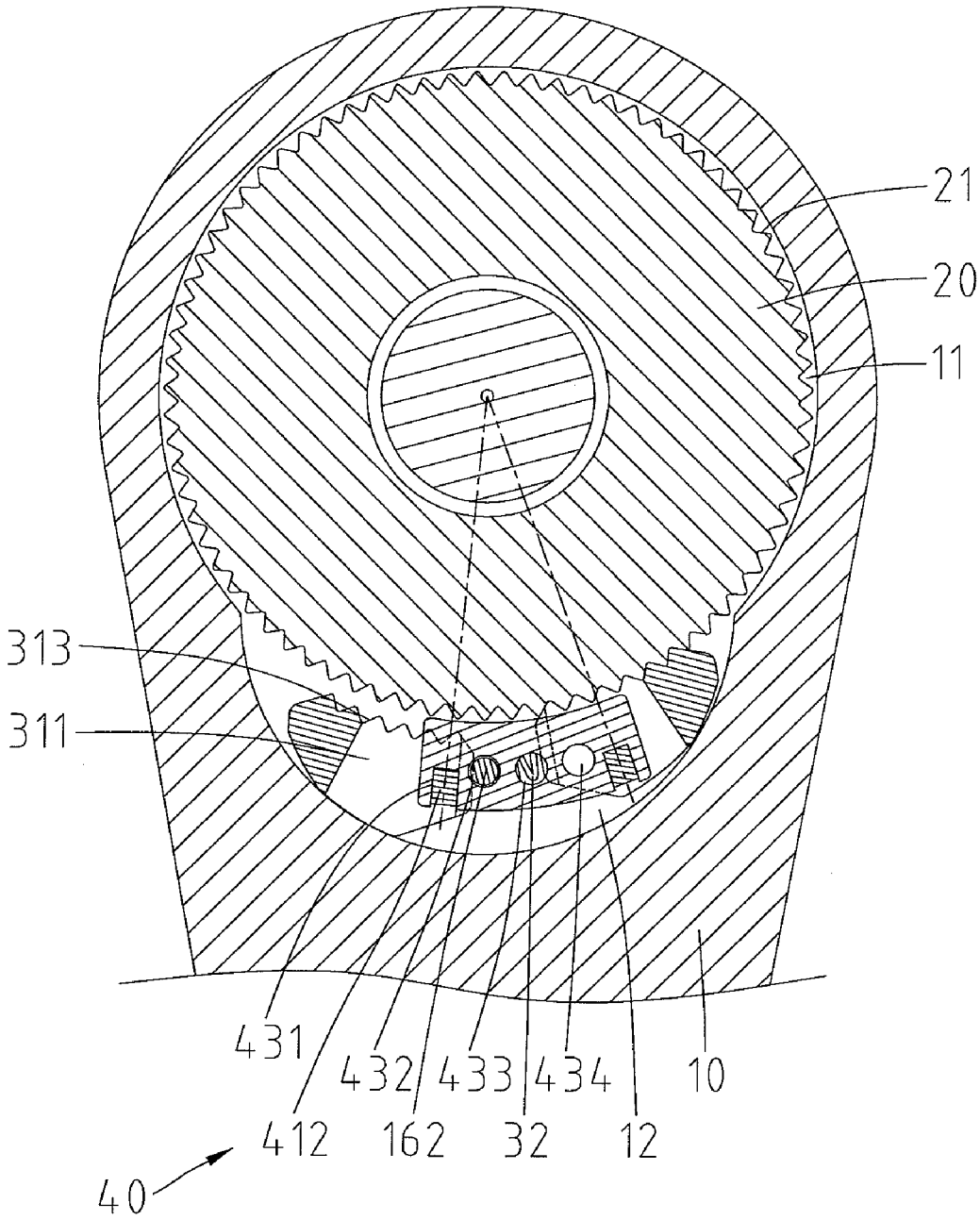
FIG. 5 is a cross sectional view similar to FIG. 3 with the switch in a first position.
Figure 6:
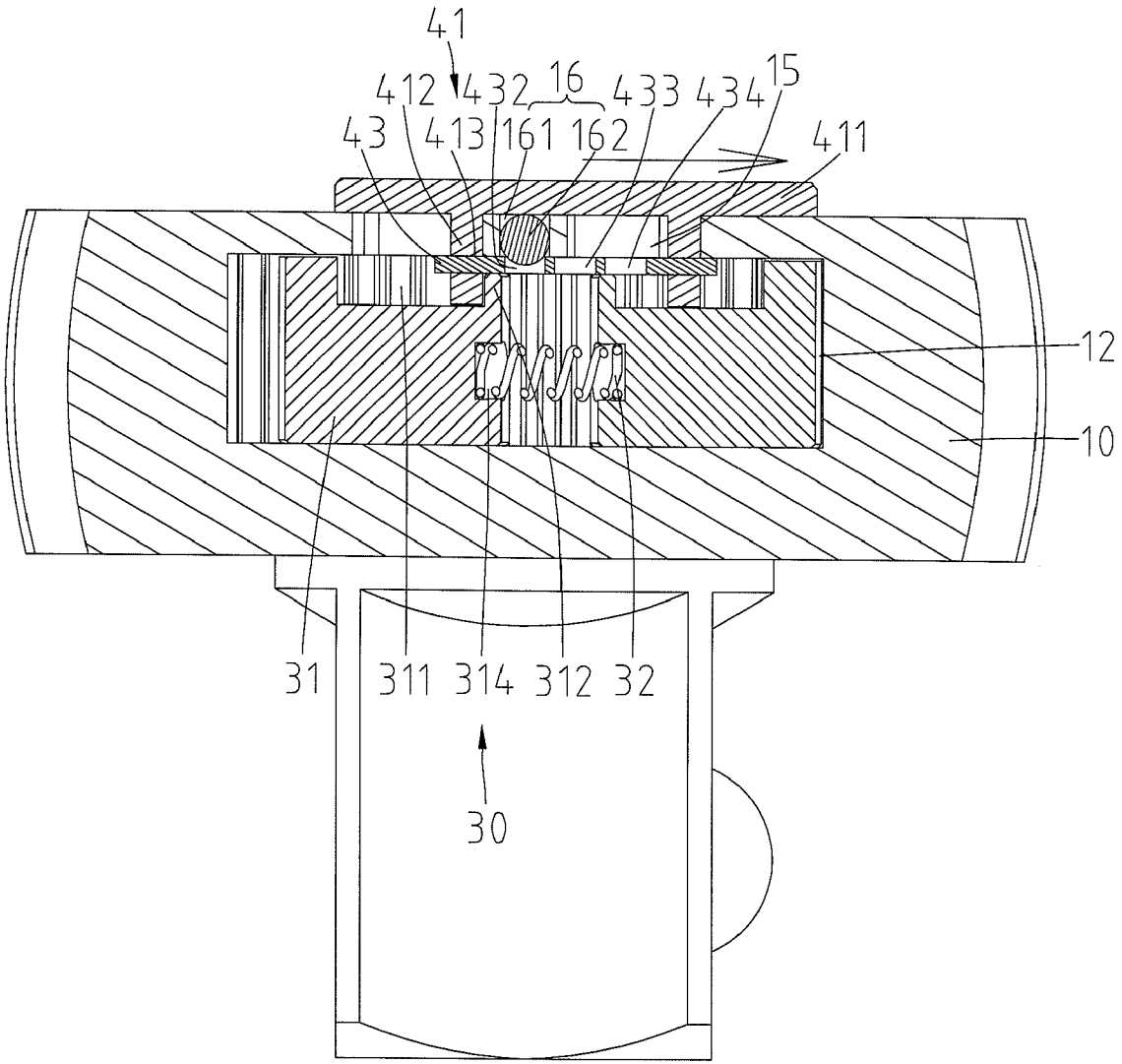
FIG. 6 is a cross sectional view similar to FIG. 4 with the switch in the first position.
Figure 7:
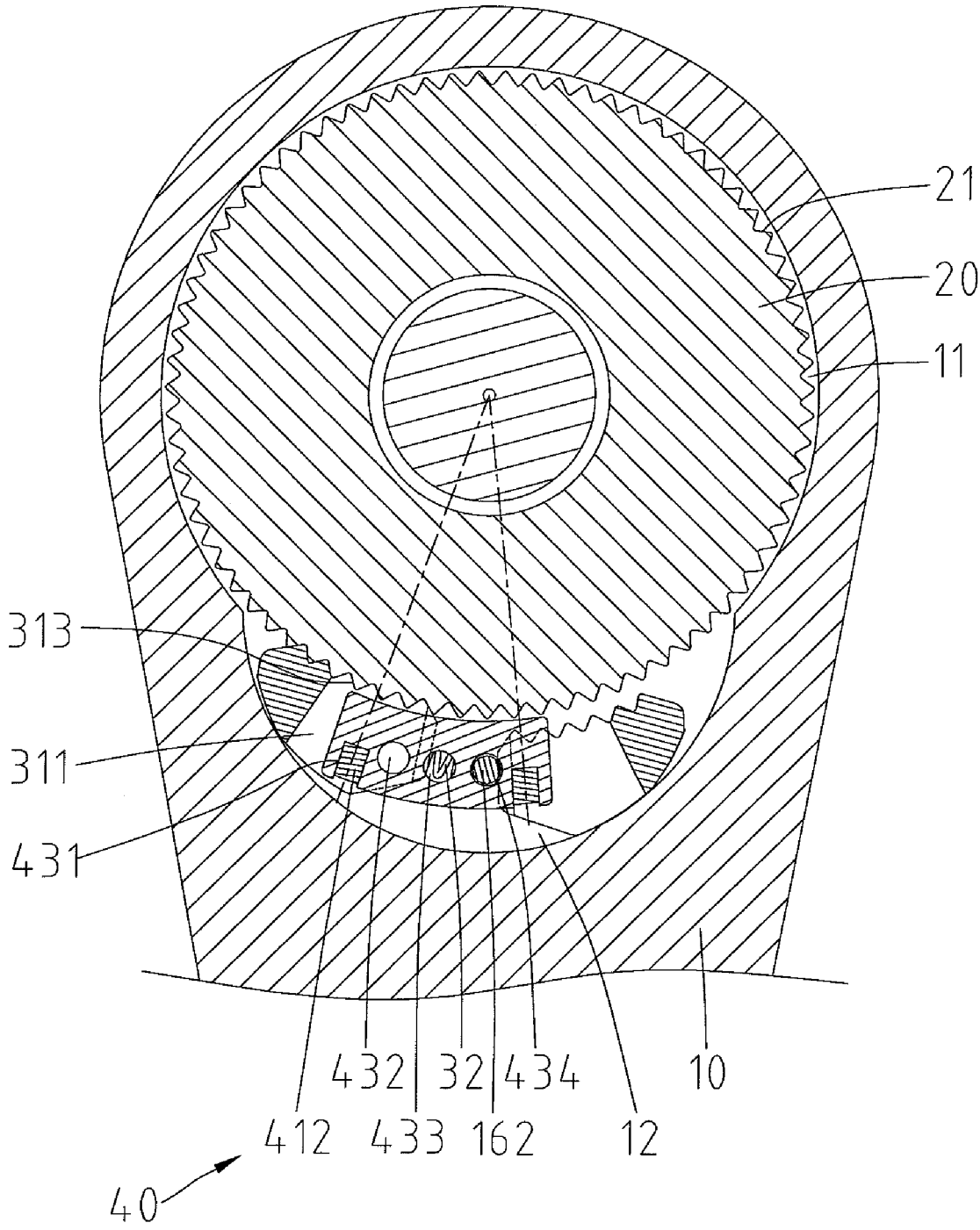
FIG. 7 is a cross sectional view similar to FIG. 3 with the switch in a second position.
Figure 8:
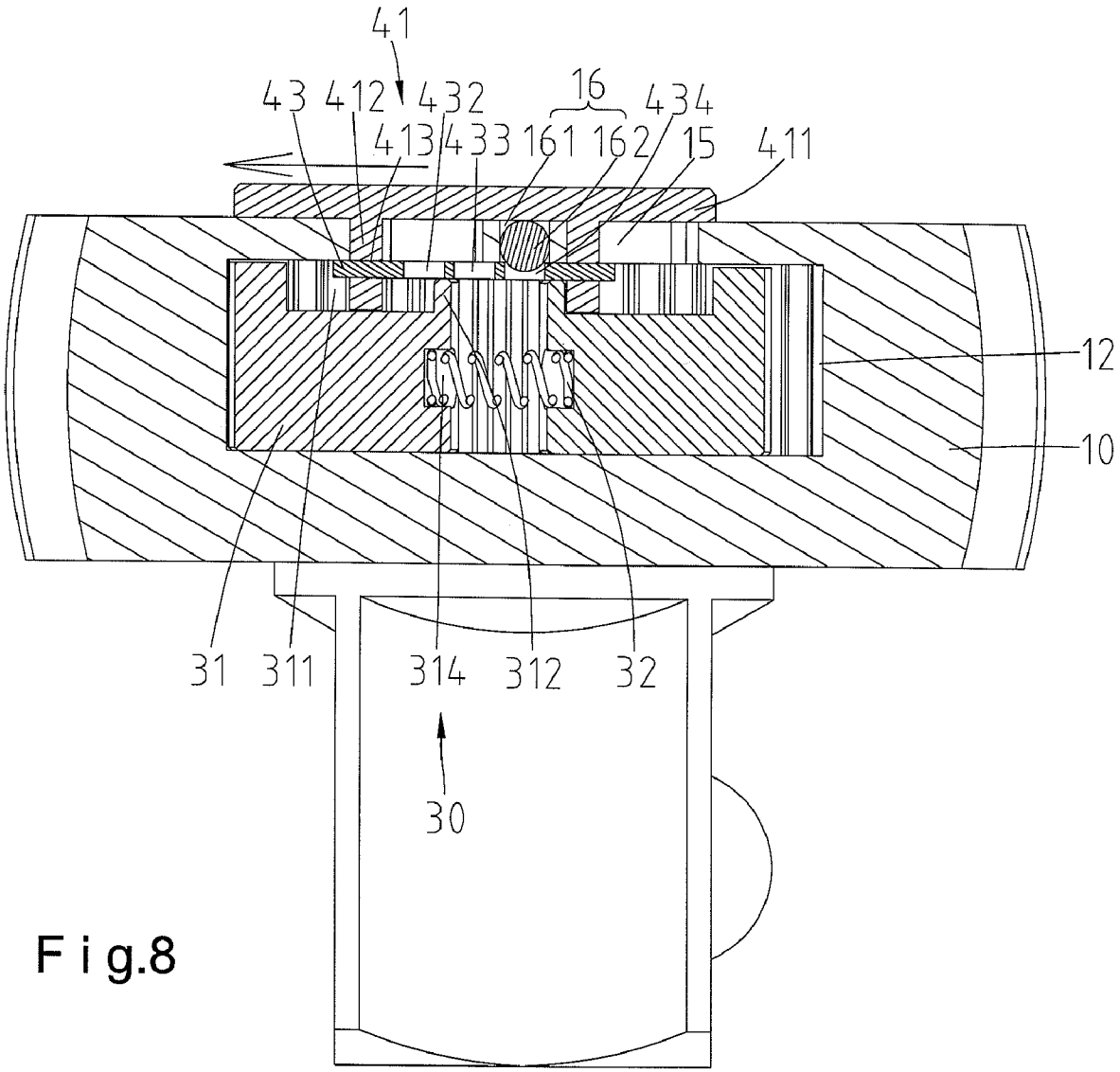
FIG. 8 is a cross sectional view similar to FIG. 4 with the switch in the second position.

Now that the basic construction of the ratchet wrench of the preferred teachings of the present invention has been explained, the operation and some of the advantages of the ratchet wrench can be set forth and appreciated. In particular, for the sake of explanation, it will be assumed that switch 41 is initially in the third position (FIGS. 3 and 4). Positioning member 162 is engaged in third positioning section 433 to retain switch 41 in position. Teeth 313 of first and second pawls 31 engage with teeth 21 of drive member 20 under action of elastic element 32. In this state, body 10 and drive member 20 can rotate jointly in either a clockwise or counterclockwise direction to drive a fastener in the same direction. Free rotation of body 10 relative to drive member 20 in either direction without driving the fastener is not allowed. Thus, the ratchet wrench according to the preferred teachings of the present invention can be utilized to perform slight tightness adjustment of the fastener when switch 41 is in the third position.

When switch 41 is in the first position (FIGS. 5 and 6), first leg 412 of switch 41 engages with coupling portion 312 of first pawl 31 to disengage teeth 313 of first pawl 31 from teeth 21 of drive member 20, and teeth 313 of second pawl 31 engage with teeth 21 of drive member 20. In this state, body 10 and drive member 20 can rotate jointly in the clockwise direction to drive the fastener in the clockwise direction. Furthermore, body 10 can rotate freely relative to drive member 20 in the counterclockwise direction without driving the fastener. Note that positioning member 162 engages with first positioning section 432 to retain switch 41 in the first position. Furthermore, when switch 41 is moved from the third position to the first position, first leg 412 of switch 41 presses against an overall area of planar inner surface 316 of coupling portion 312 of first pawl 31 to reliably move first pawl 31 without the risk of disengagement of first pawl 31. When switch 41 reaches the first position, first leg 412 of switch 41 still presses against the overall area of planar inner surface 316 of coupling portion 312 of first pawl 31.

When switch 41 is in the second position (FIGS. 7 and 8), second leg 412 of switch 41 engages with coupling portion 312 of second pawl 31 to disengage teeth 313 of second pawl 31 from teeth 21 of drive member 20, and teeth 313 of first pawl 31 engage with teeth 21 of drive member 20. In this state, body 10 and drive member 20 can rotate jointly in the counterclockwise direction to drive the fastener in the counterclockwise direction. Furthermore, body 10 can rotate freely relative to drive member 20 in the clockwise direction without driving the fastener. Note that positioning member 162 engages with second positioning section 434 to retain switch 41 in the second position. Furthermore, when switch 41 is moved from the third position to the first position, second leg 412 of switch 41 presses against an overall area of planar inner surface 316 of coupling portion 312 of second pawl 31 to reliably move second pawl 31 without the risk of disengagement of second pawl 31. When switch 41 reaches the second position, second leg 412 of switch 41 still presses against the overall area of planar inner surface 316 of coupling portion 312 of second pawl 31.

Since positioning member 162 does not move during operation of switch 41 of the ratchet wrench according to the teachings of the present invention, malfunction resulting from rusting and/or impurities in conventional reversible ratchet wrenches will not occur in the ratchet wrench according to the teachings of the present invention. Furthermore, restraining member 43 and positioning member 162 provide reliable positioning effect for switch 41 and prolong the life of the ratchet wrench according to the teachings of the present invention.

Body 10 of the ratchet wrench according to the teachings of the present invention includes only two compartments 11 and 12 for receiving driving member 20, first and second pawls 31, and restraining member 43. The manufacturing process and costs for producing the ratchet wrench according to the teachings of the present invention can be simplified and cut as compared to conventional reversible ratchet wrenches having three compartments.

Figure 9:
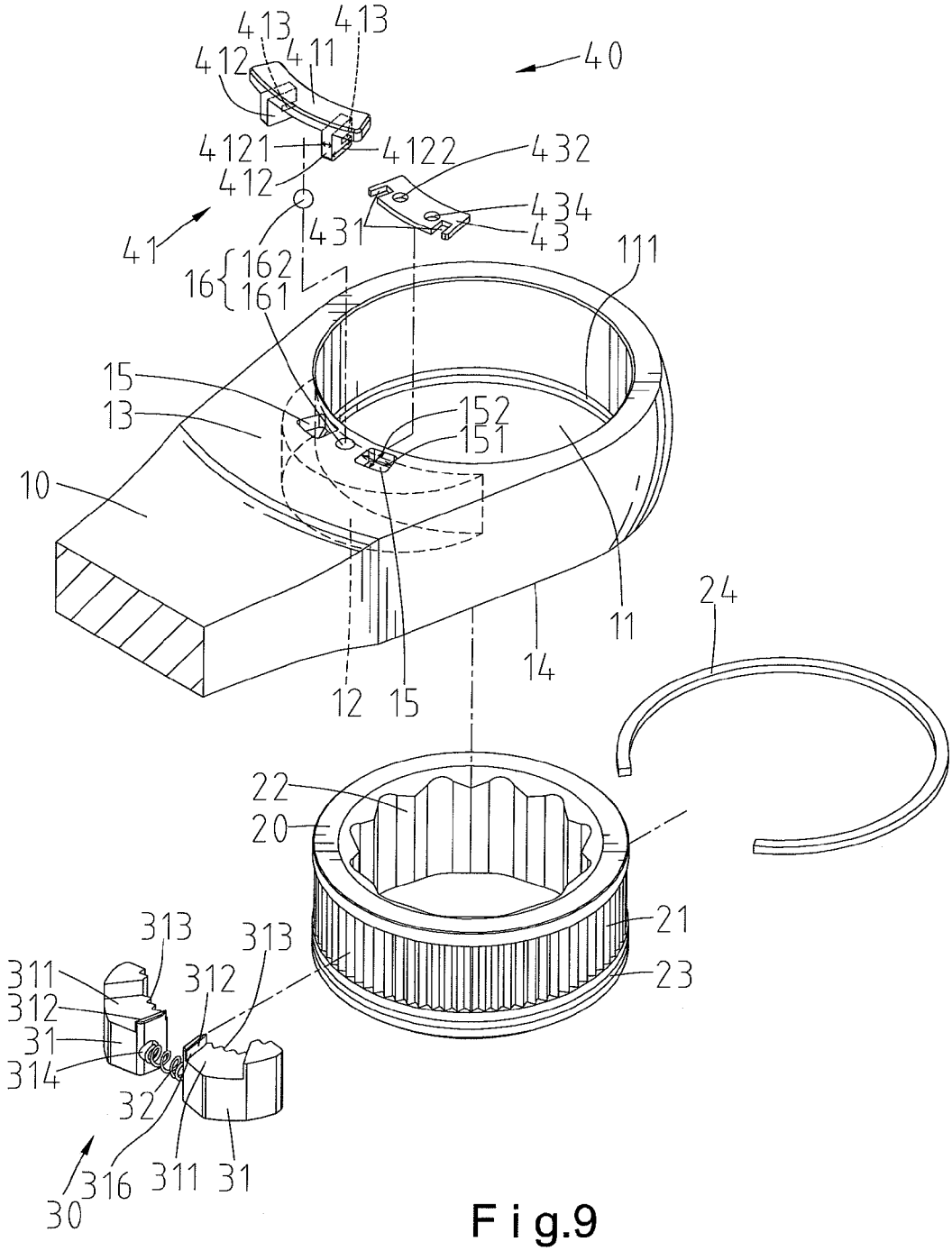
FIG. 9 shows a partial, exploded, perspective view of a ratchet wrench of another embodiment according to the preferred teachings of the present invention.
Figure 10:
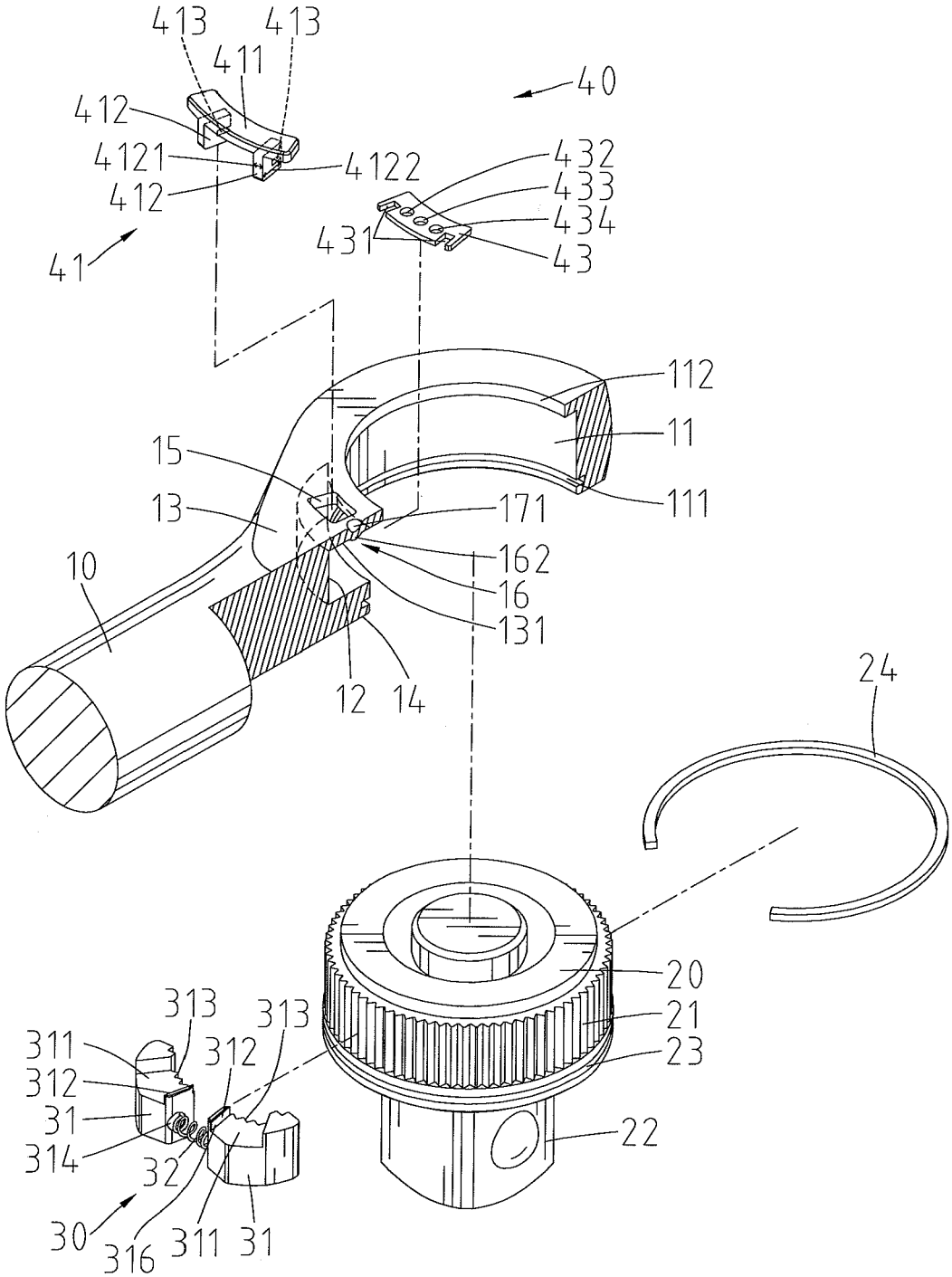
FIG. 10 shows a partial, exploded, perspective view of a ratchet wrench of a further embodiment according to the preferred teachings of the present invention.
Figure 11:
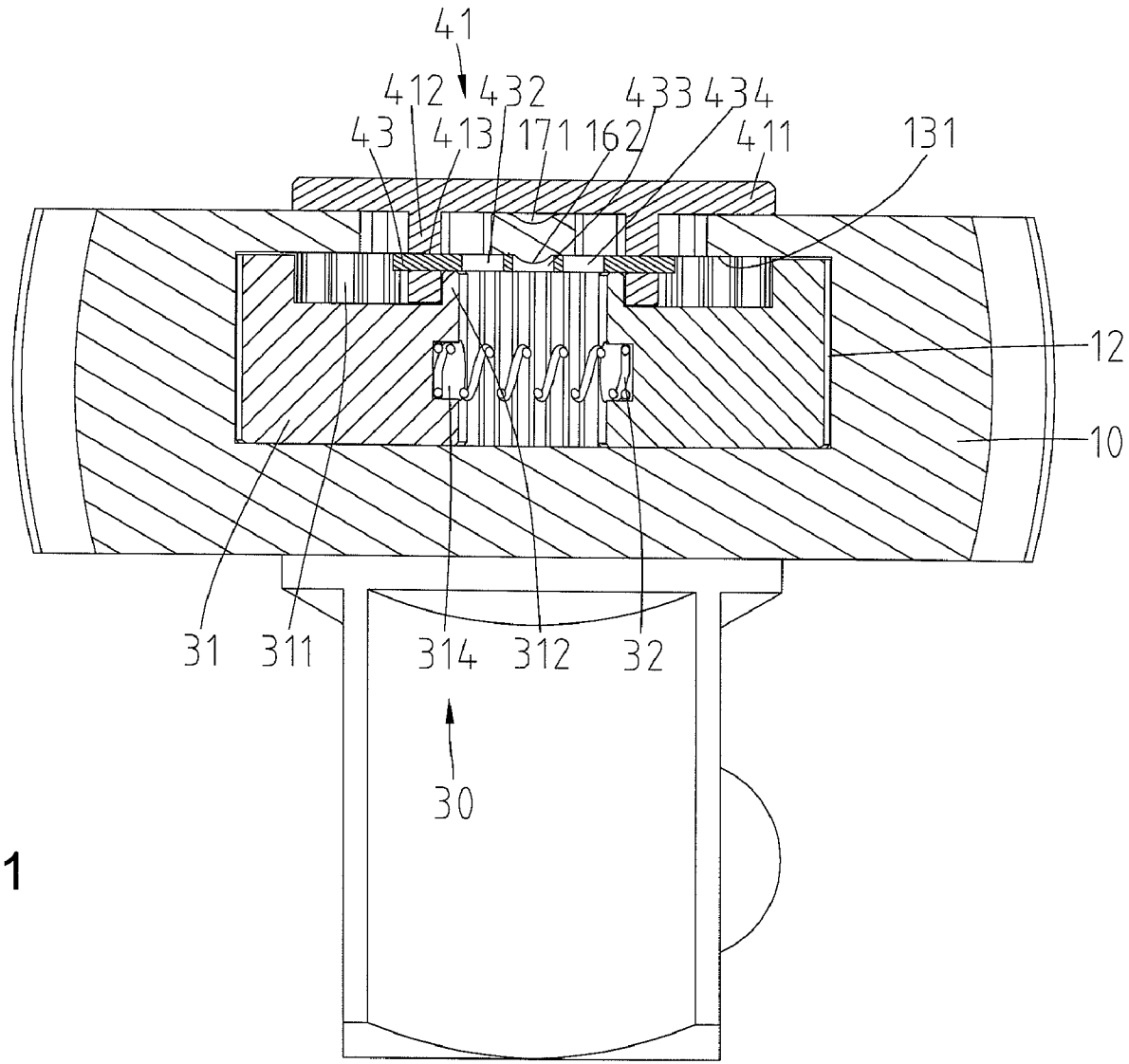
FIG. 11 shows a partial, cross sectional view of the ratchet wrench of FIG. 10 with a switch in a third position.

In the preferred form shown in FIG. 9, switch 41 can be retained in the first or second position, and restraining member 43 includes only first and second positioning sections 432 and 434. Specifically, the ratchet wrench can not be utilized to proceed with slight tightness adjustment of the fastener.

Now that the basic teachings of the present invention have been explained, many extensions and variations will be obvious to one having ordinary skill in the art. For example, the top face of first and second pawls 31 does not have to include receiving portion 311. Furthermore, switch 41 can have other forms and shapes without affecting its function. Likewise, restraining member 43 and first and second legs 412 can have other forms and shapes without affecting their functions. Further, to couple first and second legs 412 with restraining members 43, first and second legs 412 do not have to include notches 413. Alternatively, restraining member 43 does not have to include first and second cutouts 431.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a body including a first compartment and a second compartment in communication with the first compartment, with a positioning member extending into the second compartment;

a drive member rotatably received in the first compartment of the body about a rotating axis and including a plurality of teeth on an outer periphery thereof;

first and second pawls movably received in the second compartment, with each of the first and second pawls including an inner face having a plurality of teeth releasably engaged with the plurality of teeth of the drive member, with each of the first and second pawls including a top face transverse to the inner face, with the top face of each of the first and second pawls having a coupling portion;

an elastic element mounted between the first and second pawls to bias the plurality of teeth of the first and second pawls to engage with the plurality of teeth of the drive member;

a switch slideably mounted to the body between first and second positions, with the switch including a manually operable operative portion and first and second legs extending from the operative portion into the second compartment; and a restraining member slideably received in the second compartment and coupled with the first and second legs of the switch to move therewith, with the restraining member including first and second positioning sections selectively engaged with the positioning member corresponding to the first and second positions of the switch;

wherein when the switch is in the first position, the first leg of the switch engages with the coupling portion of the first pawl to disengage the plurality of teeth of the first pawl from the plurality of teeth of the drive member, the plurality of teeth of the second pawl engage with the plurality of teeth of the drive member, allowing the body and the drive member to rotate in a first direction driving a fastener in the first direction and allowing the body to rotate freely relative to the drive member in a second direction reverse to the first direction without driving the fastener, and the positioning member is engaged with the first positioning section to retain the switch in the first position, and wherein when the switch is in the second position, the second leg of the switch engages with the coupling portion of the second pawl to disengage the plurality of teeth of the second pawl from the plurality of teeth of the drive member, the plurality of teeth of the first pawl engage with the plurality of teeth of the drive member, allowing the body and the drive member to rotate in the second direction driving the fastener in the second direction and allowing the body to rotate freely relative to the drive member in the first direction without driving the fastener, and the positioning member is engaged with the second positioning section to retain the switch in the second position.

2. The ratchet wrench as claimed in claim 1, with the body including first and second sides spaced in a thickness direction in which the rotating axis extends, with the second compartment intermediate the first and second sides, with a receiving hole extending from the first side to the second compartment in the thickness direction, and with the positioning member received in the receiving hole and partially extending into the second compartment.

3. The ratchet wrench as claimed in claim 2, with the positioning member being a ball not movably but rotatably received in the receiving hole.

4. The ratchet wrench as claimed in claim 3, with each of the first and second positioning sections of the restraining member including a cylindrical hole extending in the thickness direction, with the cylindrical hole being circular in cross section and having a diameter the same as that of the ball.

5. The ratchet wrench as claimed in claim 2, with the switch being pivotable relative to the body about a pivot axis, with the body including first and second guide slots extending from the first side to the second compartment in the thickness direction, with the first and second guide slots located on opposite sides of the receiving hole, with the first leg of the switch extending through the first guide slot into the second compartment and slideable in the first guide slot in a circumferential direction in which the switch pivots about the pivot axis, and with the second leg of the switch extending through the second guide slot into the second compartment and slideable in the second guide slot in the circumferential direction.

6. The ratchet wrench as claimed in claim 5, with the first and second legs of the switch spaced in the circumferential direction, with the first and second guide slots extending and spaced from each other in the circumferential direction, with the first and second positioning sections of the restraining member spaced in the circumferential direction, and with the pivot axis coincident with the rotating axis.

7. The ratchet wrench as claimed in claim 6, with the operative portion of the switch mounted to the first side of the body and covering the first and second guide slots and the receiving hole, with each of the first and second legs including a length in a radial direction orthogonal to the circumferential direction, and with the length of each of the first and second legs equal to a radial length of each of the first and second guide slots in the radial direction.

8. The ratchet wrench as claimed in claim 7, with each of the first and second legs including a notch, with the restraining member including first and second ends spaced in the circumferential direction and engaged with the notches of the first and second legs, and with the first and second positioning sections intermediate the first and second ends of the retraining member in the circumferential direction.

9. The ratchet wrench as claimed in claim 8, with the first end of the restraining member including a first cutout, with the second end of the restraining member including a second cutout spaced from the first cutout in the circumferential direction, with the first and second positioning sections intermediate the first and second cutouts in the circumferential direction, with the first cutout engaged with the notch of the first leg, and with the second cutout engaged with the notch of the second leg.

10. The ratchet wrench as claimed in claim 9, with the notches of the first and second legs facing the drive member, with the restraining member including first and second shorter sides spaced in the circumferential direction, with the restraining member further including first and second longer sides extending between the first and second shorter sides and spaced in the radial direction, with each of the first and second longer sides having a length in the circumferential direction larger than a length of the first and second shorter sides in the radial direction, with the second longer side radially outwards of the first longer side and facing away from the drive member, with the first and second cutouts formed in the first and second ends of the restraining member at the second longer side, and with the first and second cutouts facing away from the drive member.

11. The ratchet wrench as claimed in claim 7, with the restraining member including first and second cutouts spaced in the circumferential direction, with the first and second positioning sections intermediate the first and second cutouts in the circumferential direction, with the first cutout engaged with the first leg, and with the second cutout engaged with the second leg.

12. The ratchet wrench as claimed in claim 2, with the switch being pivotable relative to the body about a pivot axis, with the coupling portion of each of the first and second pawls extending upward from the top face in the thickness direction and including a planar inner surface facing away from another of the first and second pawls, with the first leg of the switch pressing against an overall area of the planar inner surface of the coupling portion of the first pawl when the switch is in the first position, and with the second leg of the switch pressing against an overall area of the planar inner surface of the coupling portion of the second pawl when the switch is in the second position.

13. The ratchet wrench as claimed in claim 12, with the rotating axis of the driving member coincident to the pivot axis of the switch and located in a plane including the planar inner surface of the coupling portion of either of the first and second pawls.

14. The ratchet wrench as claimed in claim 2, with the restraining member further including a third positioning section intermediate the first and second positioning sections, with the switch being retained in a third position intermediate the first and second positions when the positioning member is engaged in the third positioning section with the plurality of teeth of the first and second pawls engaged with the plurality of teeth of the drive member allowing the body and the drive member to rotate in either of the first and second directions driving the fastener and not allowing free rotation of the body relative to the drive member in either of the first and second directions without driving the fastener.

15. The ratchet wrench as claimed in claim 1, with the switch being pivotable relative to the body about a pivot axis, with the body including first and second sides spaced in a thickness direction in which the rotating axis extends, with the second compartment intermediate the first and second sides, with the body including an inner surface delimiting the second compartment, with the inner surface facing the top faces of the first and second pawls, with the positioning member including a protrusion extending from the inner surface into the second compartment in the thickness direction, and with the protrusion and the body being integrally formed as a single and inseparable component of a same material.

16. The ratchet wrench as claimed in claim 15, with the first side of the body including first and second guide slots extending from the first side to the second compartment in the thickness direction, with the first leg of the switch extending through the first guide slot into the second compartment and slideable in the first guide slot in a circumferential direction in which the switch pivots about the pivot axis, and with the second leg of the switch extending through the second guide slot into the second compartment and slideable in the second guide slot in the circumferential direction.

17. The ratchet wrench as claimed in claim 16, with the first and second legs of the switch spaced in the circumferential direction about the pivot axis, with the first and second guide slots extending and spaced from each other in the circumferential direction, with the first and second positioning sections of the restraining member spaced in the circumferential direction, and with the pivot axis coincident with the rotating axis.

18. The ratchet wrench as claimed in claim 17, with the operative portion of the switch mounted to the first side of the body and covering the first and second guide slots, with each of the first and second legs including a length in a radial direction orthogonal to the circumferential direction, and with the length of each of the first and second legs equal to a radial length of each of the first and second guide slots in the radial direction.

19. The ratchet wrench as claimed in claim 15, with the coupling portion of each of the first and second pawls extending upward from the top face in the thickness direction and including a planar inner surface, with the first leg of the switch pressing against an overall area of the planar inner surface of the coupling portion of the first pawl when the switch is in the first position, and with the second leg of the switch pressing against an overall area of the planar inner surface of the coupling portion of the second pawl when the switch is in the second position.

20. The ratchet wrench as claimed in claim 15, with the restraining member further including a third positioning section intermediate the first and second positioning sections, with the switch being retained in a third position intermediate the first and second positions when the protrusion is engaged in the third positioning section with the plurality of teeth of the first and second pawls engaged with the plurality of teeth of the drive member allowing the body and the drive member to rotate in either of the first and second directions driving the fastener and not allowing free rotation of the body relative to the drive member in either of the first and second directions without driving the fastener.

* * * * *